United States Patent [19]

Negrussi

[11] Patent Number: 4,964,585

[45] Date of Patent: Oct. 23, 1990

[54] SLITTING AND REWIDING MACHINE

[75] Inventor: Luigi Negrussi, Sartirana Lomellina, Italy

[73] Assignee: Sted Engineering S.R.L., Alessandria, Italy

[21] Appl. No.: 495,389

[22] Filed: Mar. 16, 1990

Related U.S. Application Data

[63] Continuation-in-part of Ser. No. 197,112, May 20, 1988, abandoned.

[30] Foreign Application Priority Data

May 20, 1987 [IT] Italy ..... 20603 A/87
Apr. 18, 1988 [IT] Italy ..... 21087/88[U]

[51] Int. Cl.[5] ..... B65H 19/20; B65H 19/18

[52] U.S. Cl. ..... 242/56 R; 242/56 A; 242/58.1; 242/65

[58] Field of Search ..... 242/56 A, 56 R, 65, 242/58.1–58.6; 156/187, 446, 578

[56] References Cited

U.S. PATENT DOCUMENTS

| | | | |
|---|---|---|---|
| 3,148,843 | 9/1964 | Turner et al. | 242/56 A |
| 3,470,052 | 9/1969 | Herman | 156/187 X |
| 3,519,903 | 7/1970 | Carter, II | 242/56 A X |
| 3,552,670 | 1/1971 | Herman | 242/56 A |
| 3,871,595 | 3/1975 | Smolderen | 242/56 A |
| 4,564,149 | 1/1986 | Barzanc | 242/58.1 |
| 4,583,698 | 4/1986 | Nistri et al. | 242/56 R |
| 4,723,724 | 2/1988 | Bradley | 242/56 R |

*Primary Examiner*—John Petrakes
*Attorney, Agent, or Firm*—Abelman Frayne Rezac & Schwab

[57] ABSTRACT

A machine for slitting sheet material into continuous strips and winding those strips into coils includes a change-over mechanism by which a fully wound coil is replaced by a replacement core and the winding of a subsequent coil proceeds without interruption of the winding process.

2 Claims, 2 Drawing Sheets

SLITTING AND REWIDING MACHINE

FIELD OF THE INVENTION

The invention relates to a slitting and rewinding machine for the manufacture of paper tapes and the like.

The machine is particularly suited to insertion in a continuous processing train.

BACKGROUND OF THE INVENTION

Present slitting and rewinding machines used for the preparation of tapes of paper, plastics material or other material, commonly are equipped with multi-blade cutting rollers under which sheet material from a load coil located upstream of the cutting rollers passes downstream of the cutting rollers and is wound into finished coils.

In these machines, the finished coils of material are removed when the outside diameter of the finished coil reaches a maximum permitted diameter as related to the width of the coiled strip.

Each time a finished coil of cut strip material reaches that maximum diameter, it is necessary to stop the machine, sever the strips, secure the trailing cut ends to their associated finished coils, discharge the finished coils, load a new core for the next coils, and connect the leading ends of the strips to the newly loaded core. Even if the sheet material to be cut can be supplied continuously, the machines must be kept idle for fairly long periods of time.

Another condition detectable in the present plants is that trademarks, signs, decorations, addresses, information drawings or other printed indicia are present on the cut strips. The printing operation is at present carried out preceding or following the cutting of the sheet material. This requires further steps of unwinding and rewinding of the sheet material or cut strips, with consequent losses in time in the loading, discharge, and connection of the end of the strips of sheet material to another core.

SUMMARY OF THE INVENTION

The object of this invention is to eliminate the above problems.

The invention solves the problems by providing a slitting and rewinding machine in which the following results are obtained:

the slitting of the ends of the cut strips, and the replacement of the ends of the cut strips, and the replacement the finished coils by an empty core proceeds automatically without having to stop the machine;

the finished coils can be discharged from the machine while the machine is in full production and without any loss of time;

the slitting and rewinding machine can be inserted into a production line which includes a complete printing step which precedes the steps of slitting the sheet material into strips and rewinding into coils.

The advantages of this invention are that, the removal of finished coils wound from the cut strips, the securement of the ends of the finished wound coils, the securement of the ends of the strips to be wound, the cutting of the ends of the strips, and, the insertion of replacement cores all takes place quickly and automatically with notable gains in productivity.

Another advantage consists in the fact that the sequential coupling of the unwinder, the slitter and the rewinder makes it possible to further reduce production time, in this manner increasing productivity while providing products of excellent quality.

DESCRIPTION OF THE DRAWINGS

The invention is now described with reference to the accompanying drawings, in which.

DESCRIPTION OF THE PREFERRED EMBODIMENT

Figure 1:
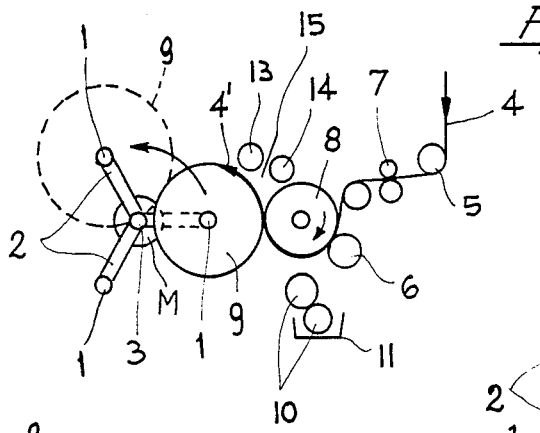
FIG. 1 is a basic operating diagram of the slitting and rewinding machine.

As shown in FIG. 1, a series of replacement cores 1 are supported at their ends by spokes 2 carried by a motorized axle 3, which is mounted for rotation in fixed bearings and which is indexed through determined angles of rotation by a conventional indexing motor M.

A continuous sheet of sheet material 4 is guided and maintained taut by rollers 5 and 6, and passes under a multi-bladed cutting roller 7, of known type, which cuts the sheet material into strips 4'. The strips 4' then pass around a motorized feed roller 8 driven by a conventional motor (not shown), and are wound onto a core 1 into a plurality of coils 9 arranged axially of the core 1, the cores 1 each being supported in bearings accommodating parallel strips or tapes wound onto a single core. For clarity of description, the coil 9 is now referred to as a multiple coil 9.

Figure 2:
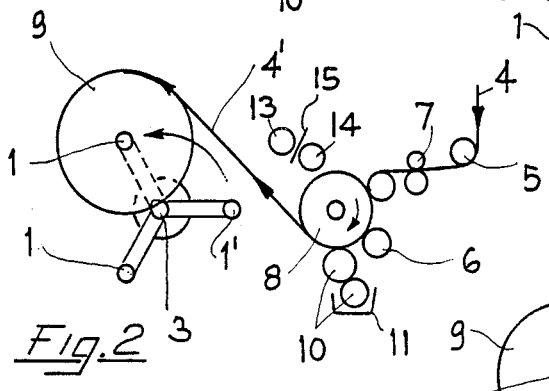
FIGS. 2–5 show in sequence the steps of winding a finished coil; displacement of the wound coil; alignment of a replacement core; cutting of the strips; and securement of the cut ends of the strips.

As shown in FIG. 2, when the multiple coil 9 has reached its required diameter, the motorized axle 3 is indexed through a determined angle by the indexing motor M, thus moving the multiple coil 9 arcuately counterclockwise and out of alignment with the motorized feed roller 8. At this point the speed of the respective rollers 5, 6 and 8 is reduced. At the same time rollers 10 approach the motorized feed roller 8 and transfer a suitable adhesive from a tray 11, and spread it on the strips 4' entrained around the motorized feed roller 8.

A sub-assembly comprised of the guide rollers 5–6, the motorized feed roller 8, the cutting roller 7, the adhesive transfer rollers 10, and a cutting unit 13, 14, 15 described later, is mounted in any conventional manner for movement towards and away from a core 1 presented thereto, and is biassed towards the motorized axle 3 by any conventional biassing means. The sub-assembly is shown in FIG. 2 in a retracted position relative to the motorized axle 3, which has been caused by the progressively increasing radius of the coil 9.

Figure 3:
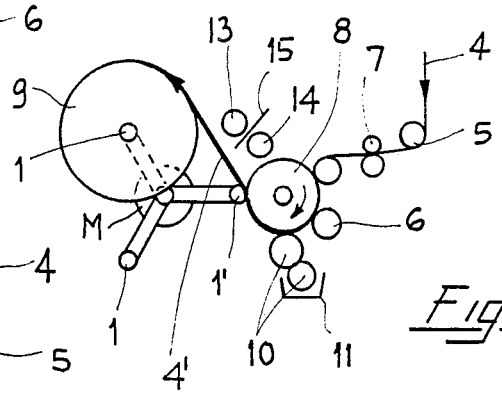

As shown in FIG. 3, the entire sub-assembly then moves under the influence of the biassing means towards a replacement core 11, which has at that time moved into alignment with the motorized feed roller 8, until such time that the feed roller 8 comes into contact with the core 1'.

On this contact, the adhesively coated tapes or strips 4' are compressed between the feed roller 8 and the replacement core 1', and, become adhered to that core 1' which then commences to rotate by the frictional drive from the motorized feed roller 8.

Figure 4:
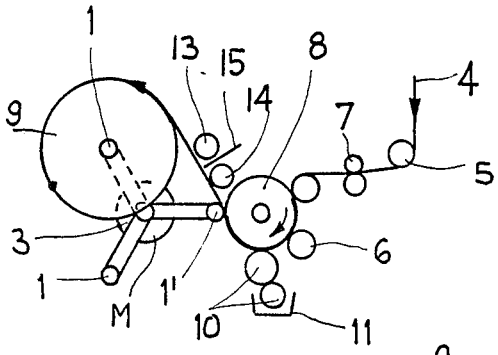
Figure 5:
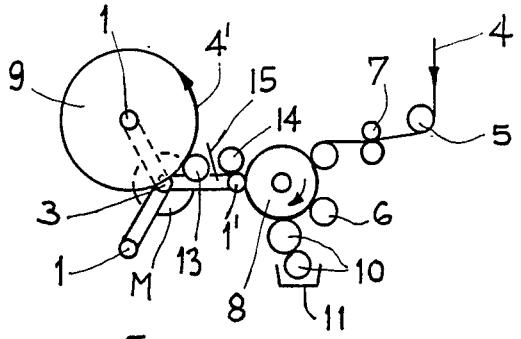

Referring now to FIG. 4, the cutting change unit 13, 14, 15 then approaches the strips 4' to bring a roller 13 into contact with the formed multiple coil 9, and to bring another roller 14 into contact with the replacement core 1' as shown in FIG. 5, the cutting change unit being supported and moved in this manner by any convenient means.

At this point, (FIG. 5), the blade 15 cuts all of the strips 4', while the roller 13 moves further into contact with the formed multiple coil 9 to adhere the cut ends of strips to that multiple coil 9. At the same time the roller 14 moves into contact with the replacement core 1' to adhere the other ends of the strips 4' to that core 1'.

When this operation is complete, the adhesive application unit 10, 4, 11 and the cutting change unit 13, 14, 15 return to their initial positions, and the slitting and winding steps resume at normal speed.

Figure 7:
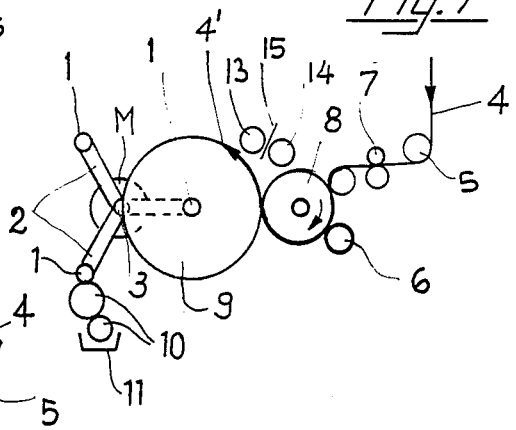

Optionally, and as shown in FIG. 7, the adhesive application unit 10, 11 can be placed in alignment with a core 1' at a position in advance of the motorized feed roller 8, and that core 1' is employed to transfer adhesive to the strips 4'.

When the next coil 9 has reached its maximum size, the motorized axle 3 again is indexed moving the finished coil 9 by one angular position of the motorized axle 3. The adhesive applying rollers 10 then move towards the feed roller 8, and the sub-assembly 5–15 moves towards the motorized axle 3 to bring the motorized feed roller 8 into engagement with the next core 1' and the process is repeated.

All the above operations are automatically controlled in sequence by a microprocessor, which also controls mechanisms which lock the new cores ready for winding, and which release those of the finished multiple coils 9. This provides a fully automatic, robotized system.

By use of the invention, it is thus possible to continuously carry out the removal of finished multiple coils 9, and the installation of new cores to be wound, and in a manner eliminating time during which the machine is inoperative, and in turn increasing the productivity of the machine.

Obviously, if sheet material already coated with a layer of self-adhesive material are to be cut and wound, the devices 10, 11 for applying the adhesive can be eliminated.

Figure 6:
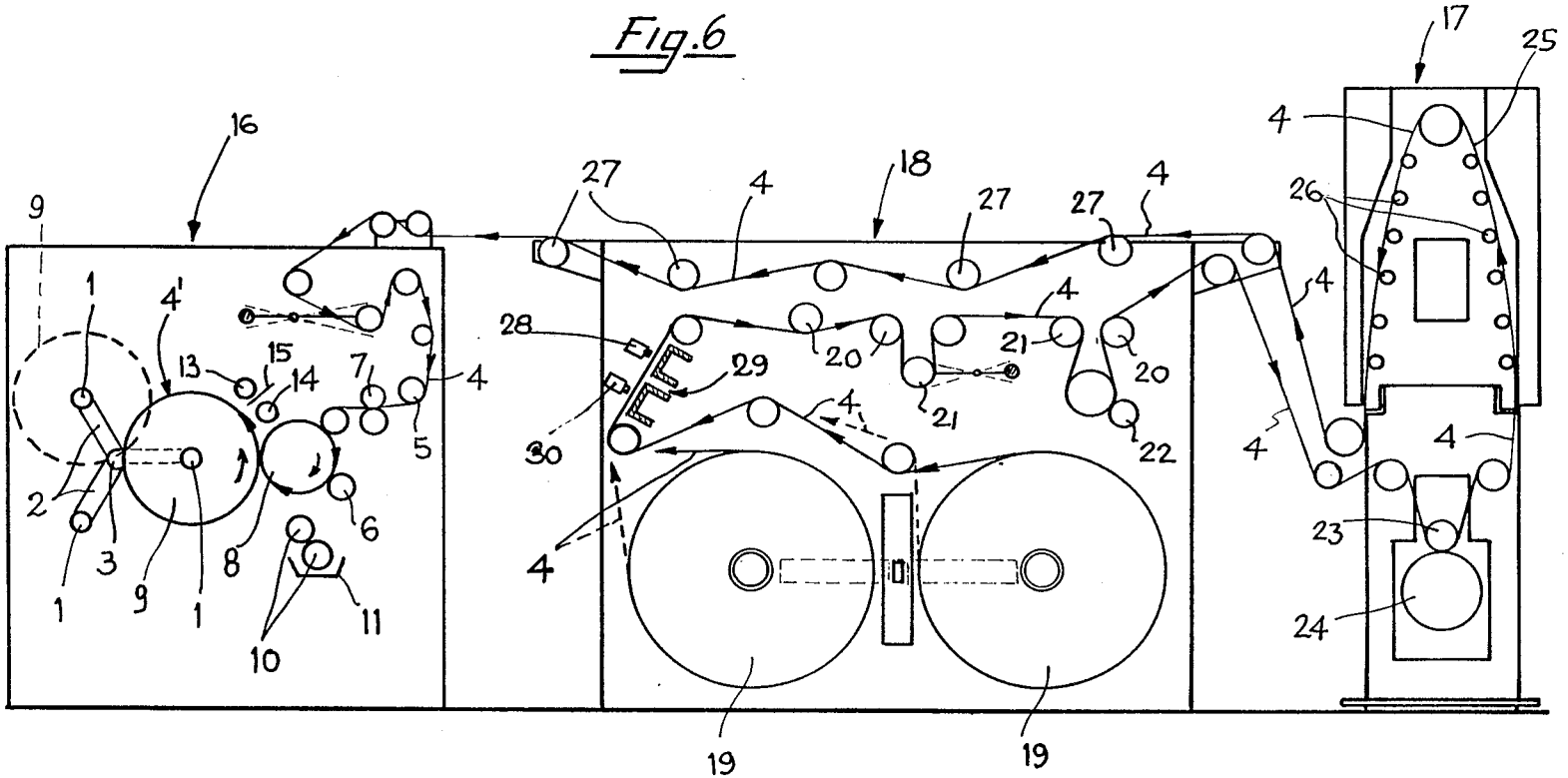
FIG. 6 is a diagrammatic side view of the slitting and rewinding machine when coupled to a printing machine and an unwinder, and, FIG. 7 shows an alternative embodiment of the machine.

With reference to FIG. 6, the cutting-rewinding machine 16 is incorporated into a continuous processing train including a printing station 17, supplied by an unwinding, and vice versa.

In the unwinding sequence, the end of a coil on completion of unwinding is locked by a piston 28 and rethreaded by means of a through-blade through a slit 29, after which the end of the following coil is also locked by a piston 30 and rethreaded with the same blade, in the same way as the end of the previous coil.

The sides of the top of the two coils are thus flanked and rethreaded in the same way, making their union, by means of adhesive tape, easy and rapid.

In particular, to make connection of the coils safer and more effective, the sides are more extended and need a larger quantity of adhesive tape or similar material. Although each remains in its own supporting seat, the continuous strips 4 are thus unwound and sent by the coils 19, following a route of guide rollers 20, tension rollers 21 and pressure rollers 22, to the printing station 17.

In said station, the continuous strips 4 are made to pass between the press-roller 23 and printing roller 24, then conveyed along a drying route 25, supported by guide rollers 26.

Subsequently, by means of a plurality of conveyor rollers 27, the continuous strips 4 are sent to a cutting-rewinding machine 16 according to the present invention, and are subjected to slitting and rewinding operations to provide multiple coils 9, as described in detail above.

The continuous processing train, comprising an unwinding unit 18, a printing station 17, and a cutting-rewinding machine 16 permits the production of printed strips or tapes in decidedly shorter times than possible with the present techniques.

I claim:

1. A machine for the continuous production of coils of strip material from a continuous sheet of material comprised by:

an axle, including motor means for indexing said axle, and, fixedly mounted bearing means supporting said axle for rotation about a longitudinal axis of said axle;

support arms extending radially of said axle at positions spaced axially of said axle and for the support of core members extending parallel to said axle, said support arms including bearing means accommodating rotation of said respective core members about the longitudinal axis of said respective core members;

a sub-assembly comprised of tensioning rollers, slitting cutters, and a driven feed roller for continuously slitting and feeding cut strips of said sheet material to successive ones of said core members to form coils of said strip material on said core members;

means for driving said feed roller;

said feed roller providing a frictional drive to a selected one of said core members to wind coils of said strip material on said selected core member;

means mounting said sub-assembly, including said feed roller, for movement in a direction radially of the longitudinal axis of said selected core member, and for moving said feed roller into frictional driving engagement with said selected core member;

biassing means for moving said sub-assembly, including said feed roller in a direction to bring said driven feed roller into frictional driving engagement with said selected core member;

means for severing said strips of strip material on completion of the winding of a coil of preselected diameter on said selected core member; and, means for indexing said axle on completion of the winding of a coil of a preselected diameter on said core member to move a successive one of said core members into the position of said selected core member to permit commencement of a subsequent winding operation of said strips of strip material onto said successive core member upon the return of said feed roller into frictional driving engagement with said successive core member under the influence of said biassing means.

2. The machine of claim 1, including means for applying an adhesive to said cut strips prior to operation of said severing means, said severing means being positioned intermediate a said formed coil and a said successive replacement core member, said severing means including rollers moveable into contact respectively with said formed coil on said selected core member and said cut strips positioned on said successive core member to adhesively attach the cut ends of said strips to the associated said coil and to said successive core member respectively and, means for moving said rollers into contact respectively with said formed coil on said selected core member and said cut strips positioned on said successive core member.

* * * * *